United States Patent [19]

Carr

[11] Patent Number: 4,637,610

[45] Date of Patent: Jan. 20, 1987

[54] BASEBALL GLOVE HOLDER AND TRAINING AID

[76] Inventor: Damon L. Carr, 860 Washoe La., Susanville, Calif. 96130

[21] Appl. No.: 698,383

[22] Filed: Feb. 5, 1985

[51] Int. Cl.[4] ..... A63B 71/02

[52] U.S. Cl. ..... 273/26 C; 2/19

[58] Field of Search ..... 273/26 R; 2/16, 19, 2/20

[56] References Cited

U.S. PATENT DOCUMENTS

| | | | |
|---|---|---|---|
| 183,045 | 10/1876 | Dunlop | 2/20 |
| 538,572 | 4/1895 | Wilson | 2/19 |
| 942,262 | 12/1909 | Iverson | 2/20 |
| 1,562,176 | 11/1925 | Latina | 2/19 |
| 3,141,173 | 7/1964 | Jackson et al. | 273/26 R |
| 4,121,824 | 10/1978 | Hirschfield | 273/26 C |

*Primary Examiner*—Richard C. Pinkham
*Assistant Examiner*—T. Brown
*Attorney, Agent, or Firm*—Plante Strauss & Vanderburgh

[57] ABSTRACT

There is disclosed a holder for a baseball glove, particularly a fielder's glove and a training aid. The holder comprises a body with a scoop formed of a stiff, shape-retaining sheet material having a rear face with a convex contour conforming to the ball pocket of a fielder's glove. The glove is received over the rear face of the scoop and is retained in this assembly by a cover which fits over the rear of the glove. Preferably, the cover is a webbing which overlies the rear of the fingers of the glove and the sheet material is a resilient plastic thereby permitting the glove former to be used as a training aid which requires the player to use both hands when fielding a ball.

9 Claims, 3 Drawing Figures

FIG 1
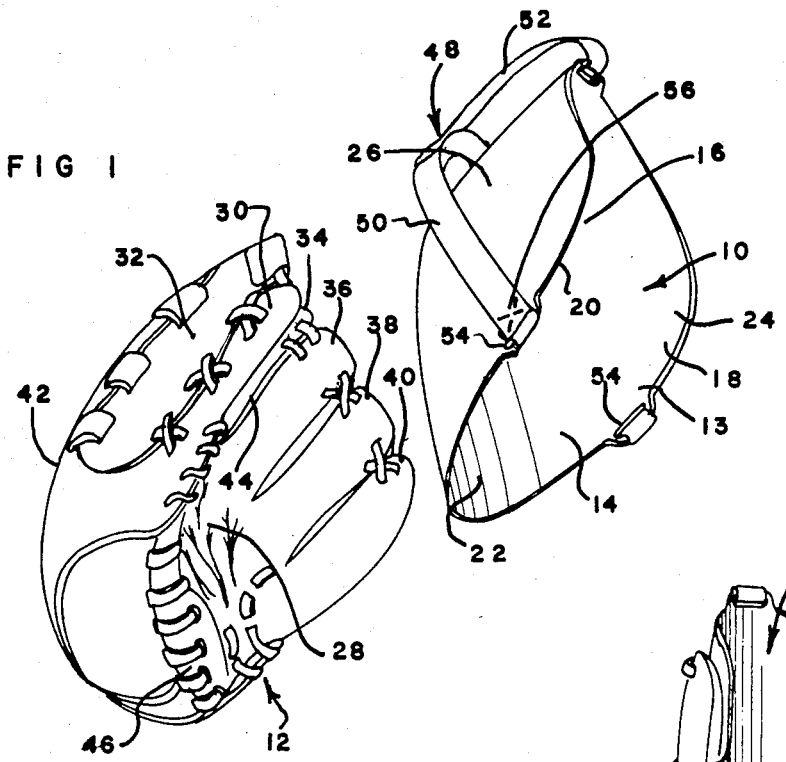
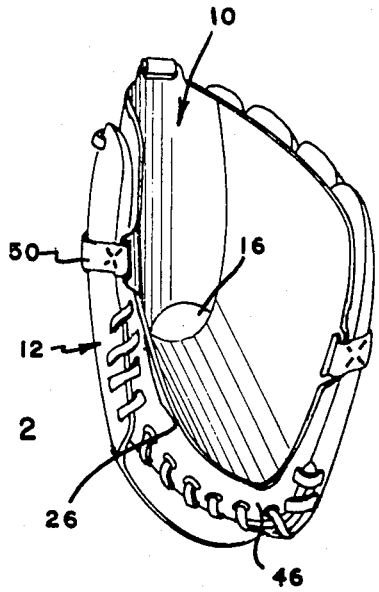
FIG 2
FIG 3
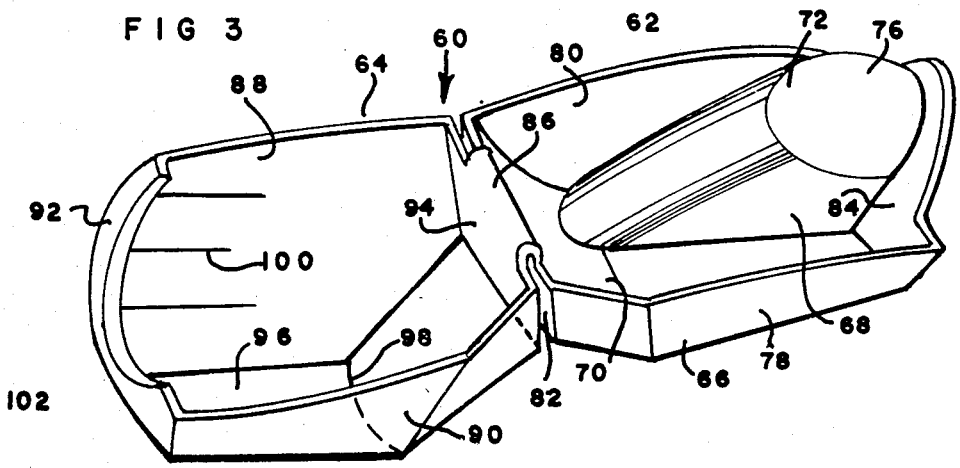

BASEBALL GLOVE HOLDER AND TRAINING AID

BACKGROUND OF THE INVENTION

1. Field of the Invention

This invention relates to a holder for a fielder's glove and, in particular, to a holder which can also be used as an aid for training players in proper fielding practice.

2. Brief Statement of the Prior Art

Fielders' gloves used for baseball, softball, and similar sports have a pocket in the palm of the glove to fit the ball and have a natural curvature to conform to the hand of the player. The gloves are fabricated of leather, a material which will undergo dimensional changes when moistened. The gloves are often mistreated following use and are usually placed in a locker or duffel bag without any protection for maintaining the shape of the glove and without any provision to maintain the shape of the pocket of the glove. Since the gloves usually become moist with perspiration and oils during use, they are very prone to deform in a locker or in a duffel bag, particularly when other gear or clothing is placed on top of the glove.

It is also difficult to train players to use both hands while fielding a ball since players naturally tend to catch a fly ball or to pick up a ground ball with only the glove hand, a practice which inevitably results in fielding errors. Some attempts have been made to strap a board on the players' bare fielding hands to force them to use both hands, however, this training aid is limited and the common training against this practice is repeated warning and coaching on the correct, two-handed play.

An attempt has been made to provide a holder for a fielder's glove in U.S. Pat. No. 4,418,849, in which a clam-shell shaped holder is provided in which a folded glove is stored. Unfortunately, the glove must be folded across its heel, and this reduces the stiffness of the heel of the glove. Also, the holder only functions to store the glove, and no provision is made to provide an aid to train players to use both hands when fielding a ball.

BRIEF STATEMENT OF THE INVENTION

This invention comprises a holder for a fielder's glove which retains the shape of the glove during storage. The holder comprises a front plate which has a three-cornered scoop formed of a stiff, shape-retaining sheet material. The scoop has a rear face with a convex contour which conforms to the front surface of the glove so the latter can be placed over the plate with the rear face of the scoop received in the ball pocket of the glove. The holder includes glove restraining means which can be a fabric webbing that extends from one side edge of the scoop area, across the rear face of the glove, to the opposite side edge. Alternatively, the restraining means can be a cover with a hinge secured to one side edge of the scoop and with a latch to secure the cover closed, about the glove. Preferably, the glove restraining means is a webbing of fabric bands and the scoop is formed of a plastic sheet material having a resiliency to permit the holder to be used as a training aid, worn over the glove during practice sessions to train fielders to use both hands when fielding balls.

BRIEF DESCRIPTION OF THE DRAWINGS

The invention will be described with reference to the FIGURES, of which:

FIG. 1 is an exploded view of the holder of the invention and a fielder's glove in a position to fit onto the holder;

FIG. 2 is a perspective view of the assembly of glove and holder of the invention; and FIG. 3 is a view of an alternative embodiment of the holder of the invention.

DESCRIPTION OF PREFERRED EMBODIMENTS

Referring now to FIG. 1, there is illustrated a holder 10 of the invention in combination with a fielder's gloove 12. The glove is shown removed from the holder 10 in the position ready for insertion of the holder 10. The holder 10 is formed of a plate 13 which includes a scoop 14 that is formed of a stiff, shape-retaining material, preferably plastic. The scoop forms a three-cornered pocket 16 with opposite side walls 18 and 20 with a rounded bight area 22. The forward face 24 of the scoop is concave, and the rear face 26 is convex, with a contour which closely matches the contour of the ball pocket 28 of the fielder's glove 12.

The fielder's glove 12 is conventional in construction and shape and has a thumb 30 which is connected with webbing 32 to the index finger 34. Commonly, the remaining fingers 36, 38 and 40 are laced together. The back surface 42 of the glove usually has no padding, and the front 44 of the thumb 30 is heavily padded, as well as the heel 46 of the glove.

The fielder's glove 12 is inserted onto the rear face 26 of the holder 10 with the rear of the three-walled pocket 16 fitting into the ball pocket of the glove. In this position, the glove retaining means 48 secures the glove to the holder 10. The preferred retaining means is in the form of webbing that includes at least one transverse or lateral band 50 of fabric, and preferably includes a short medial band 52 of fabric. The fabric bands 50 and 52 are attached to the outer edges of the holder plate 10 and to this end, the plate of the holder 10 can have slots such as 54 which receive the ends of the fabric bands which are passed through the slots and are reversed and secured by fastener means, preferably by sewing with stitches 56. In the illustrated holder, the opposite ends of lateral band 50 and the upper end of the medial band 52 are so secured, the lateral band to the opposite side edges of the holder plate, and the medial band to the top side edge of the holder plate.

Referring now to FIG. 2, the glove 12 and holder 10 are shown in assembly, with the glove fitted over the rear face 26 of the holder 10 and secured by the fabric bands 50 and 52. The bands are preferably of fabric, and can be of elastic fabric, if desired, to provide a secure retention of the holder to the front face of the glove during training sessions. Alternatively, the fabric bands can be provided with adjustable fastening means, e.g., a buckle or Velcro fasteners at one end to permit cinching of the bands tightly against the rear face of the glove 12. Once the glove is assembled to the rear face 26 of the scoop, the holder and glove can be placed in the player's locker or duffel bag and the glove will be protected against any changes in its shape or form by the stiff, shape retaining material of the holder.

The holder can also be used as a training aid during practice sessions to instruct the players to use both hands while fielding a ball. For this purpose, the material used for the holder should have a resiliency and sufficient impact strength to permit fielding a ball in the three-cornered pocket 16 of scoop 14. As apparent from FIG. 2, the player can wear the glove 12 with the holder 10 assembled to the front of the glove. In this assembly, the holder 10 is an extension of the glove. Although the material is somewhat resilient, it does not flex in the manner of the glove, and the player cannot close the glove about a ball which is received in the three-cornered pocket 16. Consequently, the player must place his other hand over the pocket 16 to retain a ball within the pocket. In this fashion, the player is habitually trained to cover the pocket with his ungloved hand when fielding a ball. A particularly preferred embodiment of the invention when the holder is to be used as a training aid for infielder's gloves is to provide a slight outwardly facing curl to the edges of sides 18 and 20, whereby the holder more closely conforms to the actual shape of the fielder's glove, matching the rounded edges of the thumb and fingers of the glove.

Useful materials for construction of the plate of the holder include such rigid plastics as acrylics and polycarbonates. When the holder is also intended to be used as a training aid, however, plastics of more resiliency are desired such as hard, synthetic rubbers, e.g., polymers and copolymers of acrylonitrile, butadiene, and sytrene; polyolefins such as polyethylene, polypropylene, polyvinylchloride, etc.

The retaining means to maintain the glove 12 in a secure position on the holder 10 can also be a cover. A suitable embodiment of this version of the invention is shown in FIG. 3, where the holder 60 is in the form of a box 62 having a cover 64 and a base 66. The base is formed with an internal wall 68 which has a convex curvature that will conform to the contour of the pocket 28 of the fielder's glove 12, shown in FIG. 1. To this end, the bottom wall 70 of the base 66 has a central, raised protuberance 72 with an inclined sidewall 74 and a rounded top 76 which closely conforms to the ball pocket 28 of the glove 12. The base can have sidewalls 78 and 80 with opposite end walls 82 and 84. The latter is raised in the center to provide retention against the heel of the glove 12 when the latter is placed, face down on the central protuberance 72. The other end wall 82 can support hinge means 86 for the folding attachment of the cover 64. The cover 64 has side walls 88 and 90 with opposite end walls 92 and 94 which mate with the corresponding walls of the base 66. The top surface 96 of the cover 64 can be peaked at its center 98 to provide clearance to permit the cover to be closed over a fielder's glove which is placed in the base 66. If desired, the inside surface of the cover 64 can have ribs such as 100 to index the cover to the fingers of the fielder's glove. Cover closure means such as a clasp can be provided on the base 66 and cover 64. A very suitable clasp can be Velcro type fasteners such as the loop end 102 attached to the end wall 92 which coacts with the cooperative fastener member 104 that is attached to the end wall 84 of the cover 64. If desired, vent apertures can be provided in the cover or base to permit the glove to dry and to prevent dampness within the closed container.

The invention has been described with reference to the presently preferred embodiment. It is not intended that the invention be unduly limited by the disclosure of the presently preferred embodiment. Instead, it is intended that the invention be defined by the means, and their obvious equivalents, set forth in the following claims.

I claim:

1. A glove retainer in combination with a baseball glove having a central ball pocket and webbing which comprises:

a. a scoop formed of a stiff, shape-retaining sheet material and having a three-sided corner pocket with a rear face having a convex contour conforming to the front surface contour of said baseball glove;

b. glove retaining means carried on the backside of the scoop and including restraining means extending across the rear surface of said baseball glove when the latter is received over the convex surface of said scoop and thereby securing said glove in assembly to said glove retainer with the rear face of said scoop received in the central ball pocket of said glove.

2. The glove retainer of claim 1 also useful as a fielder's training aid wherein said stiff, shape-retaining sheet material is a resilient plastic and wherein said restraining means comprises at least one flexible transverse band which extends across the back of the fingers of said baseball glove when the latter is in assembly to said glove retainer.

3. The glove retainer of claim 2 wherein said transverse band is a woven fabric band.

4. The glove retainer of claim 3, wherein at least one end of each of said transverse band and additional band is permanently attached at one of its ends to said scoop and distally carries removable attachment means at its opposite ends permitting its removable attachment to said scoop.

5. The glove retainer of claim 4 wherein said removable attachment means are fabric loops with cooperative loop reception means carried by said scoop.

6. The glove retainer of claim 3 wherein said restraining means comprises a fabric netting.

7. The glove retainer of claim 2 wherein said restraining means includes at least one additional band extending from the leading edge of said scoop to a mid-region of said transverse band.

8. The glove retainer of claim 1 wherein said restraining means is a cover with hinge means on one edge thereof operatively connected to the heel end of said scoop with peripheral walls to form a box which receives said baseball glove.

9. The glove retainer of claim 1 wherein said cover includes latching means carried on its edge opposite the edge carrying said hinge means.

* * * * *